US006305951B1

(12) United States Patent
Shih et al.

(10) Patent No.: US 6,305,951 B1
(45) Date of Patent: Oct. 23, 2001

(54) ELECTRICAL CONNECTOR ASSEMBLY

(75) Inventors: Yueh-Shan Shih; Chi-Sheng Wang, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/741,929

(22) Filed: Dec. 19, 2000

(30) Foreign Application Priority Data

Aug. 16, 2000 (TW) ..... 089214218

(51) Int. Cl.[7] ..... H01R 9/09

(52) U.S. Cl. ..... 439/79; 439/541.5; 439/377

(58) Field of Search ..... 439/64, 79, 80, 439/541.5, 660, 61, 374, 377

(56) References Cited

U.S. PATENT DOCUMENTS 5,636,999 * 6/1997 Hirai et al. ..... 439/79
5,688,130 * 11/1997 Huang ..... 439/79
6,116,920 * 9/2000 Yu et al. ..... 439/682
6,227,874 * 5/2001 Yu ..... 439/79

* cited by examiner

*Primary Examiner*—Hien Vu
(74) *Attorney, Agent, or Firm*—Wei Te Chung

(57) ABSTRACT

An electrical connector assembly includes a first connector (1), a guiding spacer (12) and a second connector (2). The first connector has a first housing (10) receiving two rows of first contacts (14) therein. A pair of guiding posts (106) is formed on opposite ends of a top wall (105) of the first housing for fitting into grooves (32) defined in a mating media storage device (3). The spacer includes a rectangular top wall (121) and four side walls (123) defining a chamber (120) therebetween for accommodating the second connector therein. Each first contact engages with a second contact (22) of the second connector, the second contact being soldered to a printed circuit board (4) of an electronic device. A supporting wall (124) projects upwardly from a longitudinal side of the rectangular top wall for abutting against a rear end of the top wall of the first housing.

1 Claim, 4 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly used in an electronic device, through which an external media storage device connects with a printed circuit board of the electronic device.

2. Description of the Related Art

A conventional electrical connector assembly 9, shown in FIG. 6, is used for electrically connecting an external media storage device 8 to a printed circuit board 7 of an electronic device (not shown). The connector assembly 9 comprises a first connector 90 and a second connector 92. The external media storage device 8 first engages with the first connector 90 from a horizontal direction, then the first connector 90 is inserted into the second connector 92 from a vertical direction, the second connector 92 being previously surface mounted on the printed circuit board 7. No spacer is provided for the first connector 90, which can lead to bending and to possible permanent damage to terminal pins 900 of the first connector 90 when the terminal pins 900 are inserted into the second connector 92. Moreover, the terminal pins 900 are exposed out of a housing (not labeled) of the first connector 90 for a relatively long distance, without any protective means. Therefore, the terminal pins 900 are readily damaged during assembly or transportation. Finally, there is no means in the prior art assembly which provides a guiding function to help the first connector to be correctly mounted to the media storage device 8. Hence, an improved electrical connector assembly is required to overcome the disadvantages of the prior art.

SUMMARY OF THE INVENTION

A first object of the present invention is to provide an electrical connector assembly for connecting a media storage device to a printed circuit board of an electronic device, wherein the assembly has a first connector with a positioning part thereon for guiding the first connector to smoothly connect with the media storage device.

A second object of the present invention is to provide an electrical connector assembly for connecting a media storage device to a printed circuit board of an electronic device, wherein the assembly has a first connector and a spacer for protecting contacts of the first connector from damage, and for guiding a connection of the first connector to a second connector mounted on the printed circuit board.

To achieve the aforementioned objects, an electrical connector assembly comprises a first connector, a guiding spacer and a second connector. The first connector forms an insulative first housing receiving a plurality of first contacts therein. Each first contact has a first end for electrically engaging with a corresponding pin of a media storage device and a second end extending beyond the first housing. A pair of guiding posts is formed at two opposite ends of a top wall of the first housing. A guiding spacer comprises a rectangular top wall and four side walls defining a chamber therebetween. The second ends of the first contacts extend through spacing holes defined through the rectangular top wall of the guiding spacer and into the chamber. A supporting wall projects upwardly from a longitudinal side of the rectangular top wall of the spacer and abuts against a rear end of the top wall of the first housing for securing the spacer to the first connector. The second connector has an insulative second housing fittingly inserted into the chamber and retains a plurality of second contacts therein. Each second contact has a contacting portion electrically engaging with the second end of a corresponding first contact and a tail portion for being soldered to the printed circuit board using surface mounting technology.

DESCRIPTION OF THE PREFERRED EMBODIMENT

Figure 1:
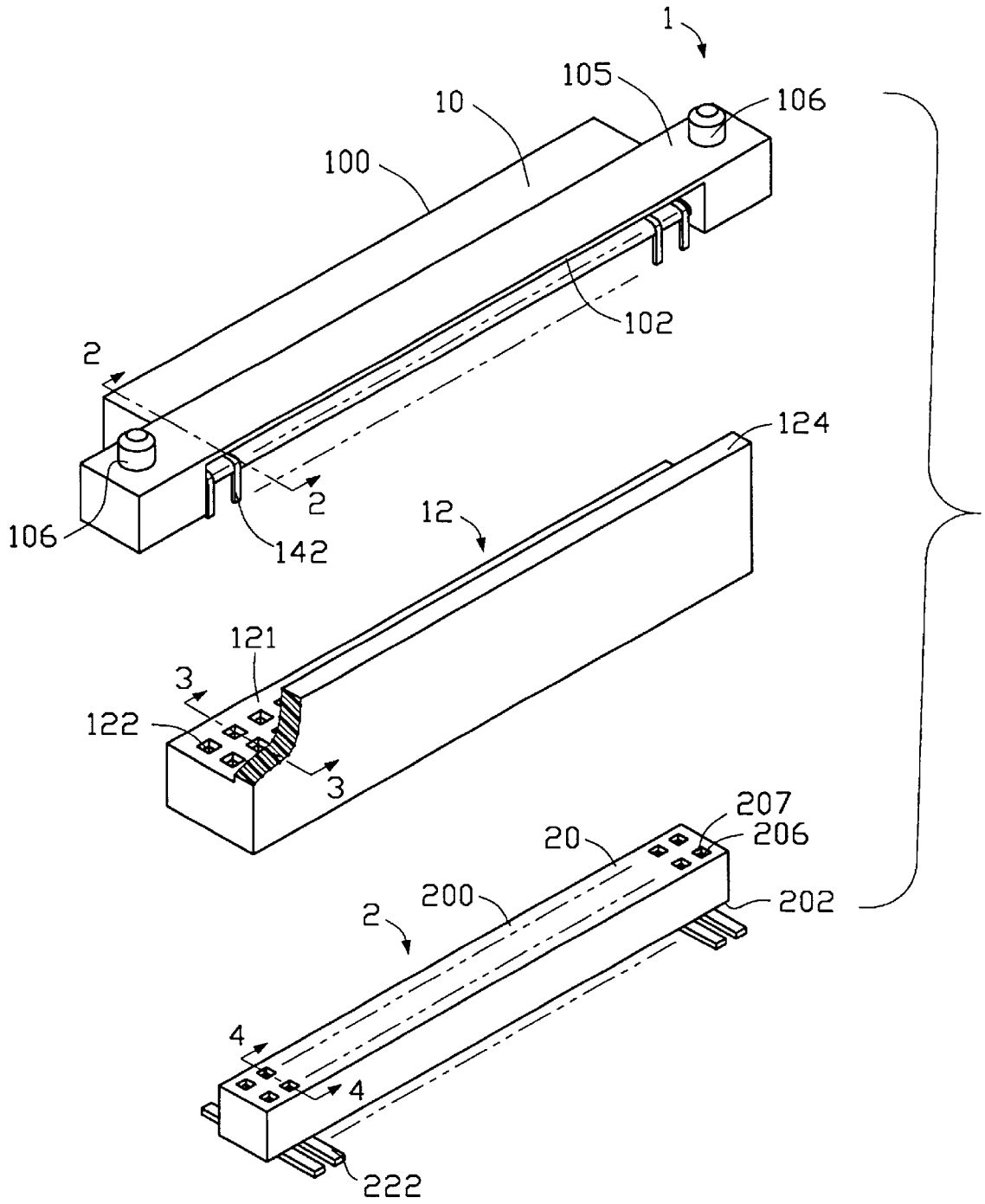
FIG. 1 is an exploded view of an electrical connector assembly in accordance with the present invention.

Referring first to FIG. 1, an electrical connector assembly in accordance with the present invention comprises a first connector 1, a second connector 2, and a guiding spacer 12.

Figure 2:
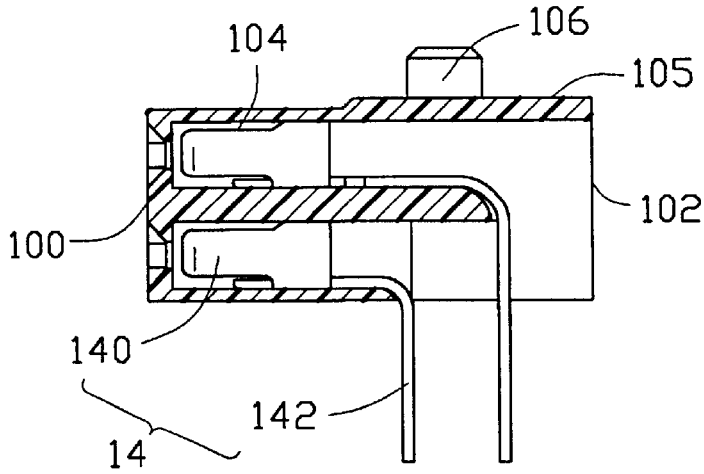
FIG. 2 is a cross-sectional view of a first connector of the connector assembly taken along line 2—2 of FIG. 1.
Figure 5:
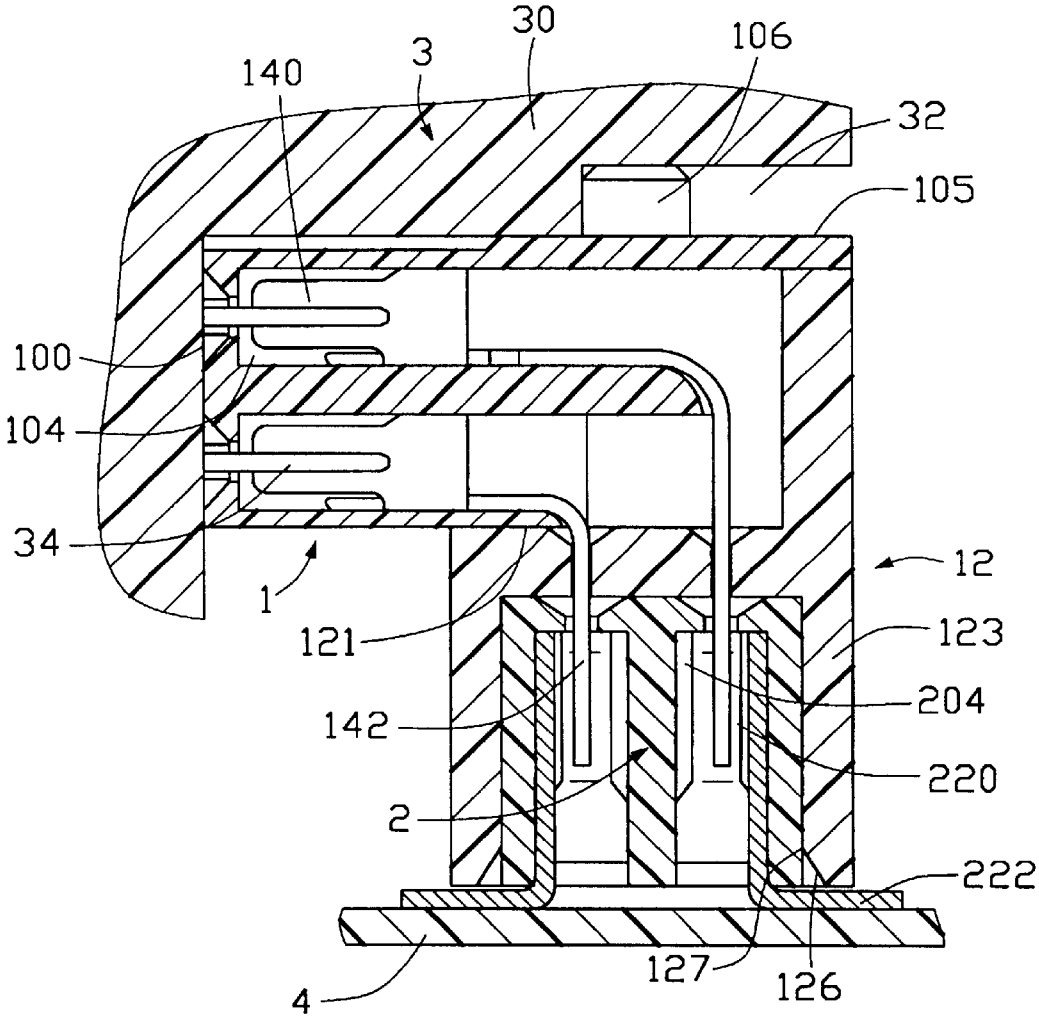
FIG. 5 is a cross-sectional view of the electrical connector assembly in accordance with the present invention electrically connecting a media storage device and a printed circuit board.
Figure 6:
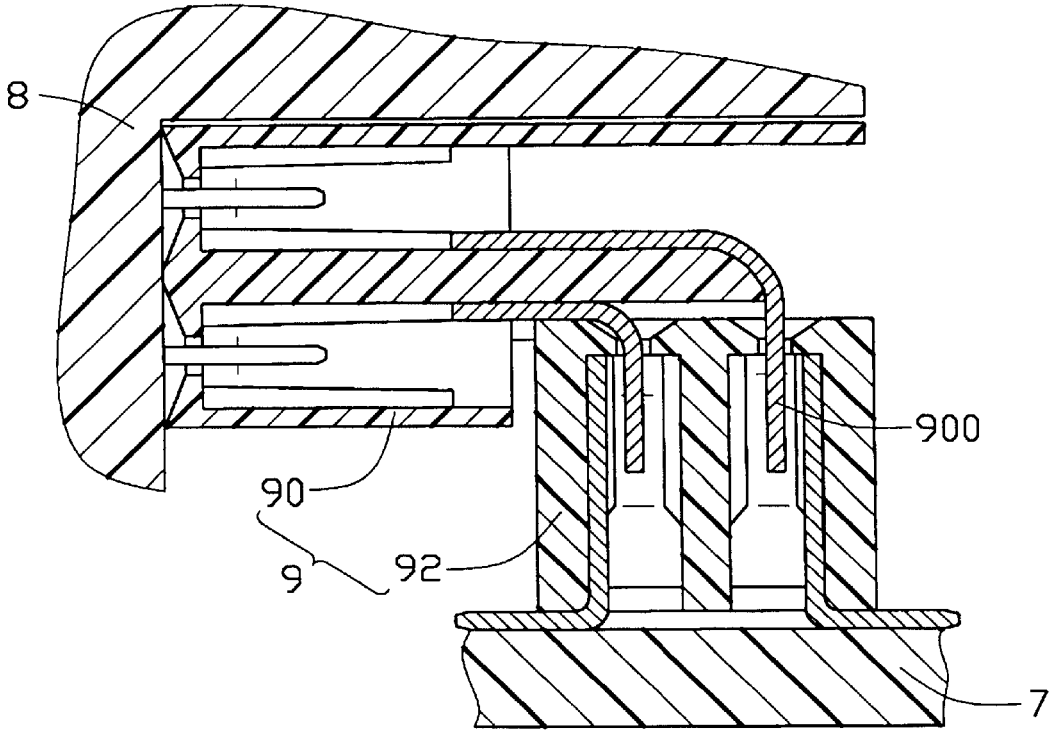
FIG. 6 (PRIOR ART)
FIG. 6 is a cross-sectional view of a conventional electrical connector assembly in use.

Referring to FIGS. 1 and 2, the first connector 1 has an elongate, insulative first housing 10 and a plurality of first contacts 14 received in upper and lower rows of passageways 104 defined in the insulative first housing 10. The housing 10 defines a front surface 100 at a forward end thereof and a rear surface 102 at a rearward end. Each first contact 14 defines a first end 140 as a receptacle terminal which is horizontally received in a corresponding passageway 104 for electrically connecting with a corresponding pin 34 of a media storage device 3 (FIG. 5). A second end 142 of each first contact 14 is defined as a pin terminal which is perpendicular to the first end 140 and extends downwardly beyond a bottom of the first housing 10. Two guiding posts 106 are formed on two opposite ends of a top wall 105 of the first connector 1.

Figure 3:
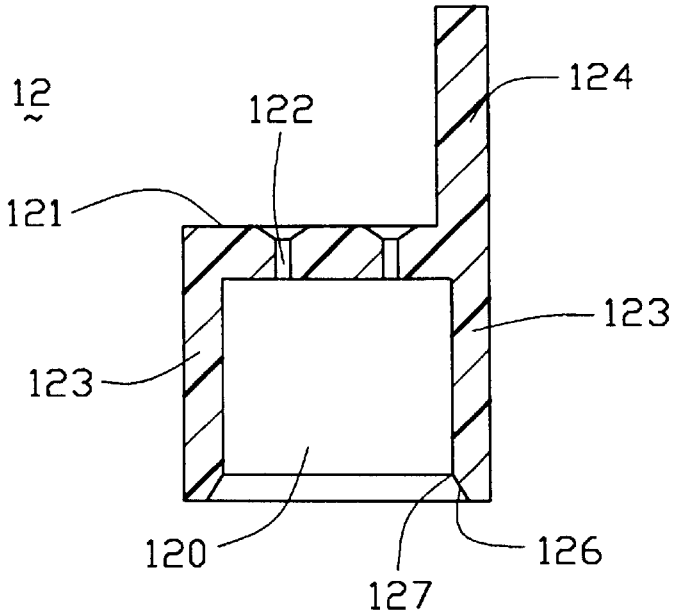
FIG. 3 is a cross-sectional view of a guiding spacer of the connector assembly taken along line 3—3 of FIG. 1.

Also referring to FIG. 3, the guiding spacer 12 comprises a rectangular top wall 121 and four side walls 123 defining a chamber 120 therebetween. A supporting wall 124 projects upwardly from a longitudinal side of the top wall 121. Two rows of spacing holes 122 are defined through the top wall 121 and in communication with the chamber 120. A chamfered guiding face 126 is formed on an inner side of a bottom edge of each side wall 123 of the guiding spacer 12.

Figure 4:
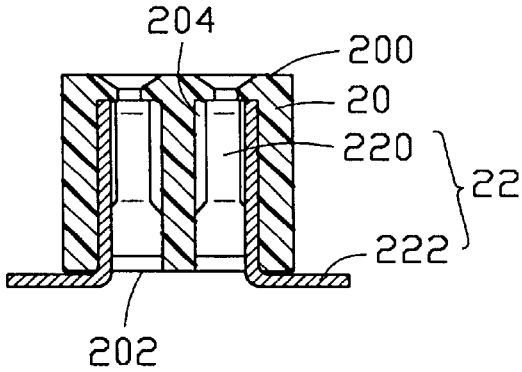
FIG. 4 is a cross-sectional view of a second connector of the connector assembly taken along line 4—4 of FIG. 1.

Referring to FIGS. 1 and 4, the second connector 2 comprises an elongated, insulative second housing 20 and a plurality of second contacts 22. The insulative second housing 20 has a mating face 200 on its top and a soldering face 202 on its bottom. A plurality of channels 204 is defined through the mating face 200 to the soldering face 202 for receiving the second contacts 22 therein. Each second contact 22 has a contacting portion 220 at an upper end thereof configured as a receptacle terminal and a tail portion 222 at a lower end and perpendicular to the contacting portion 220 at the soldering face 202. Each channel 204 forms four guiding faces 207 in a flared upper portion 206 of the channel 204 for facilitating extension of the second end 142 of a corresponding first contact 14 into the channel 204. The second connector 2 can be mounted to a printed circuit board (PCB) 4 by soldering the tail portions 222 to the PCB 4 using surface mounting technology.

In assembly, particularly referring to FIG. 5, the first connector 1 is assembled to the guiding spacer 12 by extending the second ends 142 of the first contacts 14 through the spacing holes 122 into the chamber 120 of the guiding spacer 12. A bottom (not labeled) of the first housing 10 abuts against the top wall 121 of the guiding spacer 12 and the supporting wall 124 of the guiding spacer 12 supports a rear end of the top wall 105 of the first housing 10. The second ends 142 of the first contacts 14 do not extend beyond a top edge 127 of the guiding faces 126 of the guidingspacer 12. The combination of the first connector 1 and the guiding spacer 12 is then assembled to a frame 30 of the media storage device 3 with the guiding posts 106 horizontally moving in two guiding grooves 32 defined in the frame 30 to a position at which the front surface 100 of the housing 10 abuts against a mating face (not labeled) of the frame 30 and the pins 34 of the media storage device 3 electrically engage with the first ends 140 of the first contacts 14. Finally, the media storage device 3, the first connector 1 and the guiding spacer 12 are together mounted to the second connector 2 by fittingly inserting the second housing 20 into the chamber 120 of the guiding spacer 12 to reach a position at which the mating face 200 of the second housing 20 abuts against a bottom of the top wall 121 of the guiding spacer 12 and the second ends 142 of the first contacts 14 electrically engage with the contacting portions 220 of the second contacts 22, wherein the spacing holes 122 and the channels 204 are in communication with each other.

It is to be understood, however, that even though numerous characteristics and advantages of the present invention have been set forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

We claim:

1. A combination of a media storage device, an electrical connector assembly and a printed circuit board of an electronic device, comprising:

the media storage device having a frame, said frame retaining two rows of conductive pins therein;

the electrical connector assembly comprising:

a first connector having an insulative first housing receiving a plurality of first contacts therein, each contact having a first end formed as a receptacle for electrically engaging with a corresponding pin of the media storage device, and a second end formed as a pin and extending beyond the first housing;

a guiding spacer having a top wall defining a number of holes therethrough, four side walls extending downwardly from the top wall and defining a chamber therebetween, said second ends of the first contacts extending through the holes of the top wall into the chamber;

a second connector having an insulative second housing fittingly inserted into the chamber and retaining a plurality of second contacts therein, each second contact having a contacting portion electrically engaging with the second end of a corresponding first contact and a tail portion for soldering to the printed circuit board; and the printed circuit board of the electronic device; wherein at least one post is provided on a top wall of the insulative first housing engagable with a guiding groove in the frame of the media storage device for positioning the first connector relative to the media storage device; wherein a supporting wall projects upwardly from a side of the top wall of the guiding spacer which supports a rear end of a top wall of the first housing.

* * * * *